United States Patent [19]

Patriquin

[11] 4,272,975

[45] Jun. 16, 1981

[54] CYLINDER LOCK WITH KEY REMOVABLE CORE

[75] Inventor: George P. Patriquin, Gardner, Mass.

[73] Assignee: Hudson Lock, Inc., Hudson, Mass.

[21] Appl. No.: 55,925

[22] Filed: Jul. 6, 1979

[51] Int. Cl.[3] ..... E05B 15/14; E05B 29/02

[52] U.S. Cl. ..... 70/369; 70/377

[58] Field of Search ..... 70/367, 368, 369, 376, 70/377, 392

[56] References Cited

U.S. PATENT DOCUMENTS

| | | | |
|---|---|---|---|
| 1,969,010 | 8/1934 | Jacobi | 70/369 |
| 2,061,456 | 11/1936 | Falk | 70/369 |
| 2,460,709 | 2/1949 | Navarro | 70/369 |
| 4,191,037 | 3/1980 | Patriquin | 70/369 |

*Primary Examiner*—Robert L. Wolfe

*Attorney, Agent, or Firm*—John E. Toupal

[57] ABSTRACT

Disclosed is a cylinder lock with an annular housing defining a cavity that retains a lock core formed by a cylindrical plug within an annular shell having an internal longitudinally directed shell spline. The plug is retained within the annular shell in a locked position and is rotatable therein in one direction to an open position and in the opposite direction to a release position. A plurality of locking tumblers are retained by the plug and engage the shell spline to prevent rotation of the plug from its locked position unless the locking tumblers are withdrawn from the shell spline by a properly bitted key inserted into a keyway defined by the plug. Coupled to the plug is an actuator member that moves a locking member between latched and unlatched positions in response to rotation of the plug. Also retained by the plug and engaging the shell spline with the plug in its locked position is a release tumbler shaped and arranged to permit rotation of the plug to its open position but to prevent rotation to its release position. The release tumbler also can be withdrawn from the shell spline by a properly bitted key so as to allow rotation of the plug to its release position. Relative axial movement between the housing and the core is prevented by a retainer with the plug in either its locked or open position but such movement is permitted with the plug in its release position. An operator's key is bitted to withdraw the locking tumblers and thereby permit rotation of the plug to its open position but will not withdraw the release tumbler so as to facilitate movement of the plug to its release position. That latter action is accomplished only with a master key bitted to withdraw both the locking and release tumblers so as to permit rotation of the plug to its release position wherein the retainer allows axial removal of the locking core from the housing cavity.

10 Claims, 5 Drawing Figures

CYLINDER LOCK WITH KEY REMOVABLE CORE

BACKGROUND OF THE INVENTION

This invention relates generally to a cylinder lock and, more particularly, to a cylinder lock retained by an annular operating handle and including a key removable core.

In various circumstances the locks utilized to secure certain enclosures must be periodically changed in order to prevent unauthorized access. Such a requirement exists, for example, for schools that provide an individual locker for use by each student. At the conclusion of each school year, the locks employed for individual lockers must be rotated in a manner that conceals their identify from prior users. The changing of locks typically is accomplished by a custodian or security officer equipped with a master key that operates all locks in the system. Because of the requirement for periodic lock changeover, school lockers usually are secured by expensive padlocks in combination with an appropriate lasp mechanism and operating handle.

The object of this invention, therefore, is to provide a relatively low cost, easily replaceable lock for securing enclosures equipped with handle operated access doors.

SUMMARY OF THE INVENTION

Disclosed is a cylinder lock with an annular housing defining a cavity that retains a lock core formed by a cylindrical plug within an annular shell having an internal longitudinally directed shell spline. The plug is retained within the annular shell in a locked position and is rotatable therein in one direction to an open position and in the opposite direction to a release position. A plurality of locking tumblers are retained by the plug and engage the shell spline to prevent rotation of the plug from its locked position unless the locking tumblers are withdrawn from the shell spline by a properly bitted key inserted into a keyway defined by the plug. Coupled to the plug is an actuator member that moves a locking member between latched and unlatched positions in response to rotation of the plug. Also retained by the plug and engaging the shell spline with the plug in its locked position is a release tumbler shaped and arranged to permit rotation of the plug to its open position but to prevent rotation to its release position. The release tumbler also can be withdrawn from the shell spline by a properly bitted key so as to allow rotation of the plug to its release position. Relative axial movement between the housing and the core is prevented by a retainer with the plug in either its locked or open positions but such movement is permitted with the plug in its release position. An operator's key is bitted to withdraw the locking tumblers and thereby permit rotation of the plug to its open position but will not withdraw the release tumbler so as to facilitate movement of the plug to its release position. That latter action is accomplished only with a master key bitted to withdraw both the locking and release tumblers so as to permit rotation of the plug to its release position wherein the retainer allows axial removal of the locking core from the housing cavity.

According to one feature of the invention, the retainer comprises a plug retaining pin that engages an arcuate abutment surface on the housing with the plug in either its locked or open positions or during movement therebetween. In response to movement of the plug to its release position, the pin becomes disengaged from the abutment surface permitting removal of the lock core from the housing cavity.

According to another feature of the invention, the release tumbler is a wafer having a substantially rectangular edge that engages one side wall of the shell spline to prevent rotation of the plug toward its release position and an opposite inclined edge that cams the wafer out of the shell spline during rotation of the plug toward its open position. Because of its camming function, the release wafer need not be withdrawn by an operator's key to effect rotation of the plug to its open position.

In a featured embodiment of the invention, the lock housing is formed by a hollow hub portion of a handle suitable for operating a latch mechanism of an enclosure. The hub portion is rotatably mounted in an escutcheon for mounting on the door of an enclosure. In this embodiment, the above-described locking member is a bolt retained by the lock core and movable through a slot in the handle hub portion into a latched position within a recess formed in the escutcheon. When in its latched position, the bolt prevents rotation of the handle within the escutcheon and thereby prohibits access to the enclosure.

Another feature of the embodiment described immediately above is a cam mechanism for operating the lock bolt. The cam mechanism is formed by an eccentric pin retained by the plug and engaging cam opening in the bolt. In response to rotation of the plug, the eccentric pin engages the opening and cams the bolt between its latched and unlatched positions.

DESCRIPTION OF THE DRAWINGS

These and other objects and features of the present invention will become more apparent upon a perusal of the following description taken in conjunction with the accompanying drawings wherein.

DESCRIPTION OF THE PREFERRED EMBODIMENT

Figure 1:
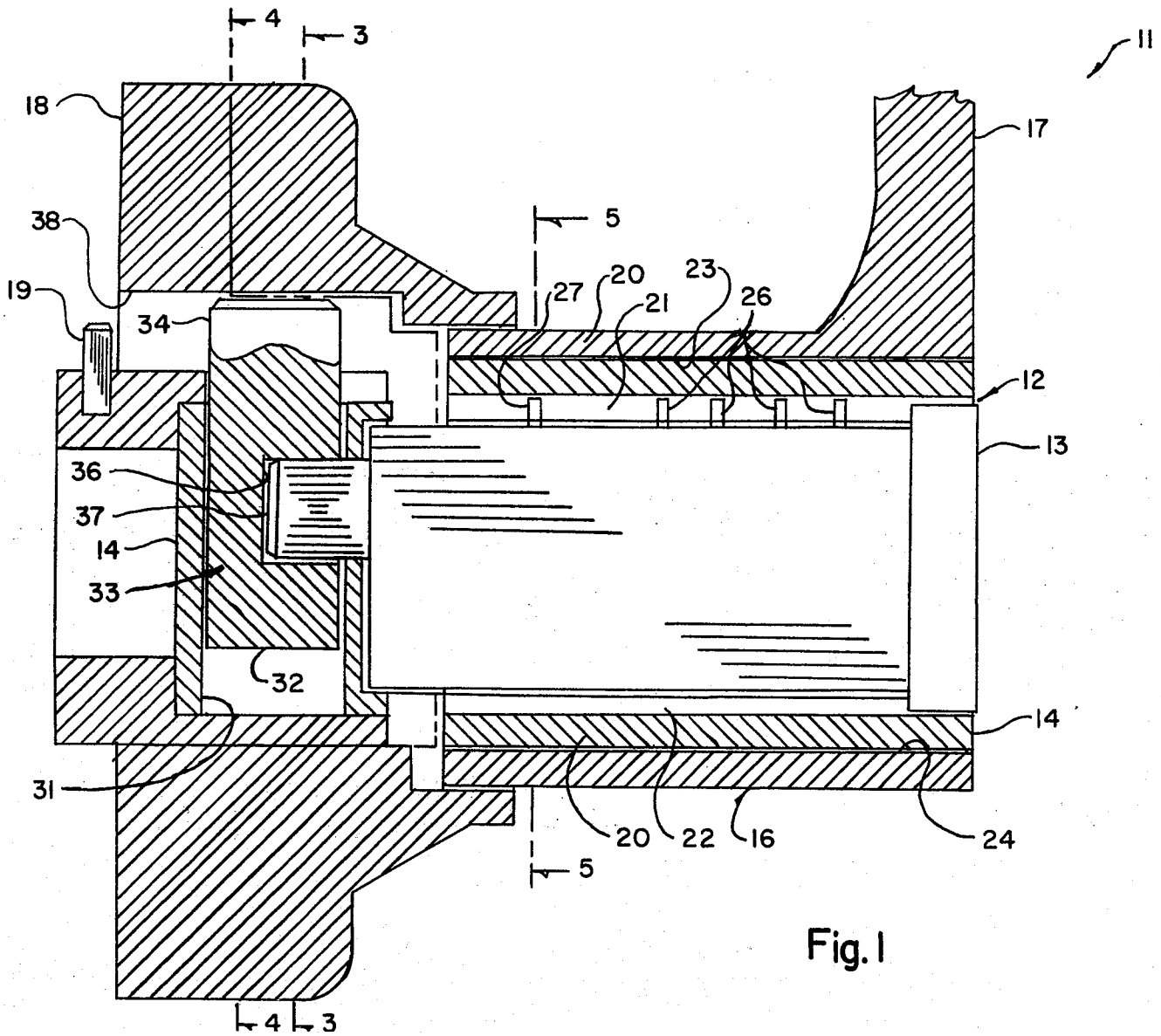
FIG. 1 is a schematic cross-sectional view of a cylinder lock according to the invention.

Referring now to the drawings, there is shown a cylinder lock 11 constructed in accordance with the present invention. The lock 11 includes a lock core 12 formed by a cylindrical plug 13 within an annular shell 14. Retaining the shell 14 is a cavity 15 formed by a hub portion 16 of an operating handle 17. The hub portion 16 is rotatably mounted within an annular escutcheon 18 and axially retained therein by a pin 19.

Figure 5:
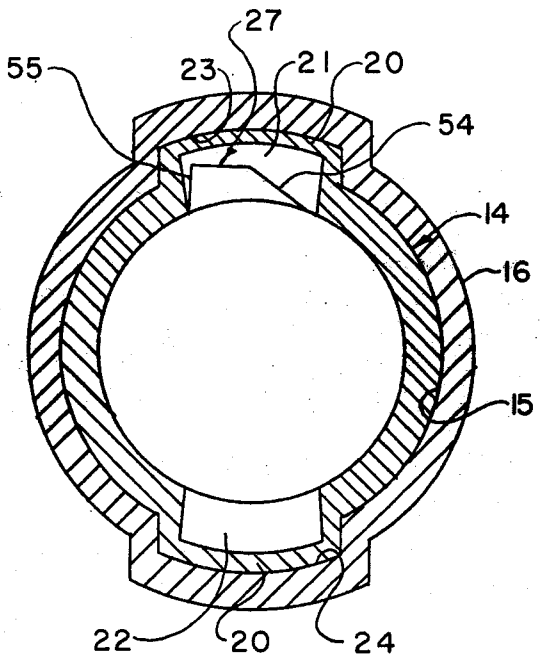
FIG. 5 is a schematic cross-sectional view taken along the lines 5—5 of FIG. 1 with the escutcheon removed.

As shown in FIGS. 1 and 5, the shell 14 includes projections 20 that define diametrically opposed, longitudinally directed locking splines 21 and 22. Accommodating the projections 20 on the shell 14 are housing splines 23 and 24 formed in the hub portion 16 of the handle 17. The plug 13 retains a plurality of locking tumbler wafers 26 that are received by the locking spline 21 with the plug 13 in a locked position. Also retained by the plug 13 is a release tumbler wafer 27 that also projects into the locking spline 21 with the plug 13 in its locked position.

Figure 2:
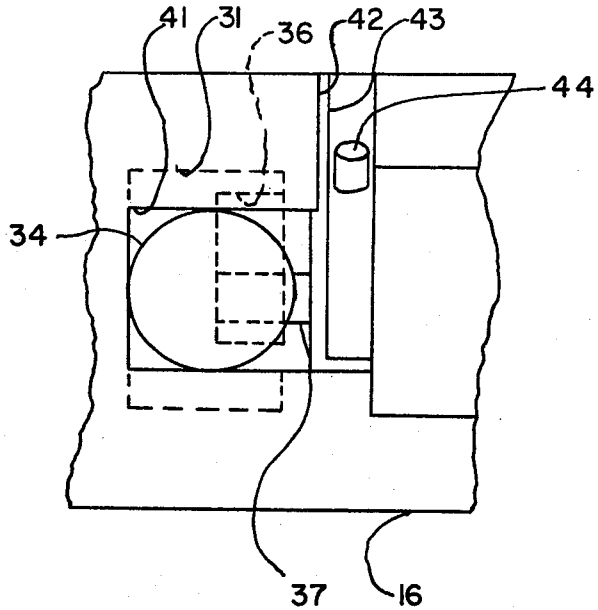
FIG. 2 is a schematic top view of a lock shown in FIG. 1 with the escutcheon removed.
Figure 3:
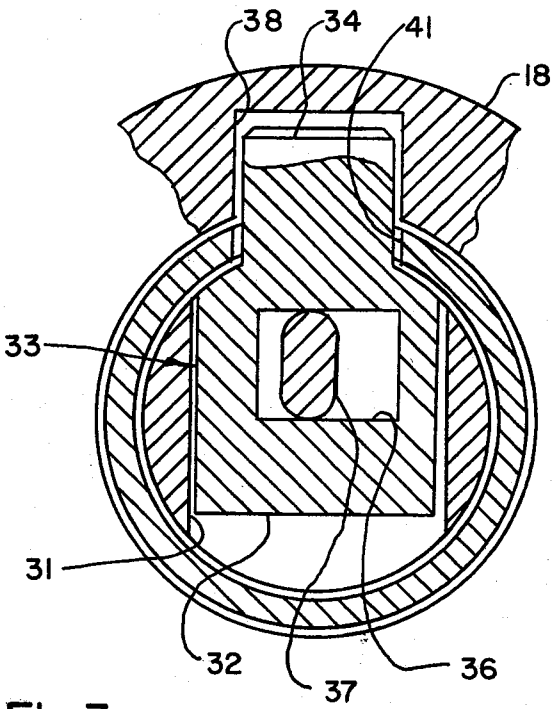
FIG. 3 is a schematic cross-sectional view taken along lines 3—3 of FIG. 1.

As shown in FIGS. 1–3, the inner end of the shell 14 possesses a slot 31 that receives and guides reciprocating linear motion of a rectangularly shaped body portion 32 of an actuator member 33. Also included in the actuator member 33 is a cylindrical bolt portion 34 that extends out of the body portion 32. Formed in the body portion 32 of the actuator member 33 is a cam opening 36 that receives an eccentric pin 37 extending from the inner end of the plug 13. In response to rotation of the plug 13, the eccentric pin 37 engages the surface of the cam opening 36 to produce linear motion of the actuator member 33 in a direction determined by the direction of plug rotation. With the plug 13 in its locked position, the bolt portion 34 of the actuator member 33 extends into a retainer slot 38 formed in the escutcheon 18 as shown in FIGS. 1 and 3.

Figure 4:
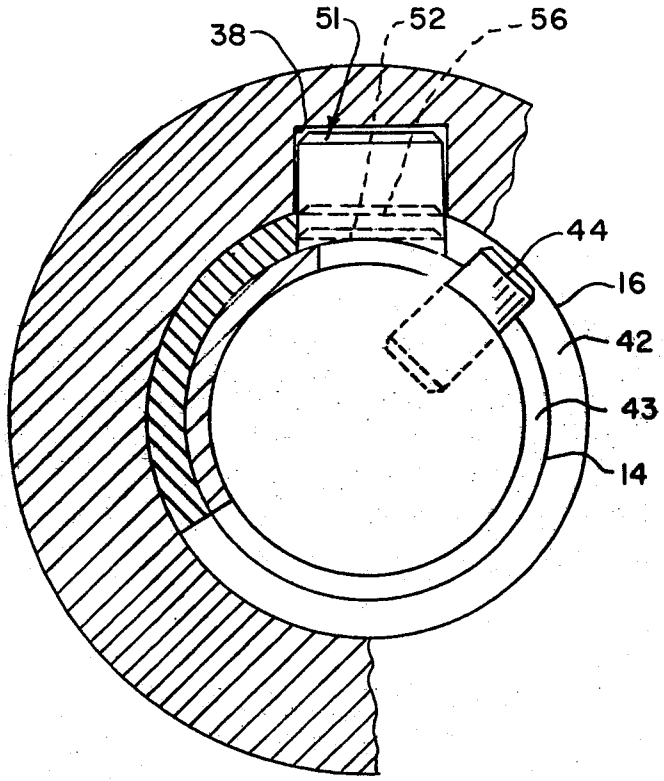
FIG. 4 is a schematic cross-sectional view taken along lines 4—4 of FIG. 1.

Formed in the hub portion 16 of the handle 17 is an L-shaped slot including a base section 41 that accommodates movement of the bolt portion 34 of the actuator member 33 and an arcuate section 42 shown in FIGS. 2 and 4. Aligned with the arcuate segment 42 and coextensive therewith is an arcuate slot 43 formed in the shell 14. Extending through the arcuate slot 43 in the shell 14 and into the arcuate slot section 42 in the hub portion 16 is a retainer pin 44 fixed to and rotatable with the plug 13. The retainer pin 44 engages the surface of the arcuate slot 42 in the hub portion 16 so as to prevent relative axial movement between the lock core 12 and the handle member 17.

During typical use of the lock assembly 11, the escutcheon 18 is mounted on the door of a suitable enclosure (not shown) such as a school locker. A conventional latch mechanism (not shown) for the door is coupled to the handle member 17 so as to be operable thereby. With the plug 13 in the locked position shown in FIGS. 1–3, rotation is prevented by the locking tumblers 26 which extend into the locking spline 21. Consequently, the bolt portion 34 of the actuator member 33 remains in a latched position extending through the slot section 41 and within the slot 38 so as to prevent rotation of the handle member 17 and thereby prevent entry into the locker. However, in response to insertion of a properly bitted operator's key into a keyway defined by the plug 13, the locking wafers 26 are withdrawn from the locking spline 21. After withdrawal of the locking wafers 26, the plug 13 can be rotated 180 degrees clockwise into an unlocked position. As shown by dotted lines in FIG. 4, this rotation of the plug 13 produces movement of the bolt portion 34 of the actuator member 33 from its latched position 51 to an unlatched position 52 outside the slot 38 in the escutcheon 18. Consequently, the handle member 17 can be rotated within the escutcheon 18 to facilitate entry into the enclosure utilizing the lock assembly 11.

During the movement of the plug 13 between its locked and open positions movement of the retainer pin 44 is accommodated by the arcuate slot 43 in the shell 14 and the arcuate slot section 42 in the hub portion 16 and engagement between the pin 44 and the surface of the slot 42 prevents axial removal of the locking core 12 from the cavity 15. Although not withdrawn by the operator's key, the release wafer 27 does not restrict the above-described clockwise rotation of the plug 13. As shown in FIG. 5, one edge of the release wafer 27 is inclined to form a cam surface 54 that cams the wafer 27 out of the locking spline 21 in response to clockwise rotation of the plug 13. However, the substantially rectangular opposite edge 55 of the release wafer 27 is firmly retained by the locking spline 21 to prevent counterclockwise rotation of the plug 13.

When replacement of the lock core 12 is desired, a master key (not shown) is inserted into the plug 13. The master key is bitted to withdraw the release tumbler 27 in addition to the locking tumblers 26 from the locking spline 21. Consequently, the plug 13 can be rotated 30 degrees counterclockwise into a release position wherein the retainer pin 44 is axially aligned with the spline 23 in the hub portion 16 of the handle member 17 and out of engagement with the surface of the arcuate slot 42. Thus, with the plug 13 in a release position, the retainer pin 44 no longer prevents relative axial movement between the lock core 12 and the handle member 17 and the plug 13 and shell 14 are easily withdrawn from the cavity 15 in the hub portion 16. As shown by dotted lines in FIG. 4, the position 56 reached by the bolt portion 34 in response to movement of the plug 13 into its release position does not extend beyond the confines of the spline 23 formed in the hub portion 16. Consequently, during withdrawal of the lock core 12, the spline opening 23 in the hub portion 16 accommodates movement of the bolt portion 34 in addition to the retainer pin 44.

The actuator member 33 serves the additional function of coupling the shell 14 to the hub 16 so as to prevent relative rotational movement therebetween. Such motion is prevented by the bolt portion 34 that is retained by the slot 31 in the shell 14 and engages the slot 41 in the hub portion 16. This feature would allow construction of the lock 11 with the engaging spline portions on the shell 14 and the hub 16.

Obviously, many modifications and variations of the present invention are possible in light of the above teachings. It is to be understood, therefore, that the invention can be practiced otherwise than as specifically described.

What is claimed is:

1. A cylinder lock comprising:

an annular housing defining a cavity;

a lock core retained within said cavity and comprising an annular shell with an inner surface defining longitudinally directed shell spline means, and a cylindrical plug retained within said annular shell in a locked position and rotatable therein in one direction to an open position and in the opposite direction to a release position;

a plurality of locking tumblers retained by said plug and engageable with said shell spline means to prevent rotation of said plug from said locked position, said locking tumblers being withdrawable from said shell spline means by a properly bitted key inserted into a keyway defined by said plug;

an actuator member coupled to said plug so as to undergo movement in response to rotation thereof;

a locking member movable between latched and unlatched positions by said actuator member;

release tumbler means retained by said plug and engaged with said shell spline means with said plug in said locked position, said release tumbler means and said shell spline means being shaped and arranged to permit rotation of said plug in said one direction and to prevent rotation of said plug in said opposite direction, said release tumbler means being withdrawable from said shell spline means by a properly bitted key inserted into said keyway so as to allow rotation of said plug in said opposite direction; and retaining means shaped and arranged to prevent relative axial movement between said housing and said core with said plug in said locked and open positions and to allow said relative axial movement with said plug in said release position.

2. A lock according to claim 1 wherein said retaining means comprises engaging portions of said housing and said core.

3. A lock according to claim 2 wherein said engaging portions comprise an arcuate abutment surface defined by said housing, and an extension portion of said plug projecting beyond the outer surface thereof and engaging said abutment surface with said plug in said locked and open positions and during movement therebetween.

4. A lock according to claim 3 wherein said cavity comprises longitudinally directed housing spline means retaining portions of said shell that form said shell spline means and terminating said abutment surface, and said extension portion is axially aligned with and receivable by said housing spline means with said plug in said release position.

5. A lock according to claim 4 wherein said abutment surface is defined by an arcuate slot in said housing and said extension portion comprises a pin retained by said plug.

6. A lock according to claim 5 wherein said release tumbler means comprises a cam portion producing disengagement with said shell spline means in response to rotational movement of said plug in said one direction.

7. A lock according to claim 6 wherein said release tumbler means comprises a wafer with a substantially rectangular edge engaging one side wall of said shell spline means to prevent rotation of said plug in said opposite direction, and an inclined edge opposite to said rectangular edge and forming said cam portion.

8. A lock according to claim 7 wherein said locking tumbler means are disposed between said release tumbler means and a front face of said plug that defines an opening to said keyway.

9. A lock according to claim 8 wherein said housing comprises a handle with a hub portion defining said cavity, said handle adapted for mounting on the door of an enclosure.

10. A lock according to claim 9 including an escutcheon retaining said hub portion and wherein said locking member engages said hub portion to said escutcheon with said plug in said locked position to prevent rotation of said handle and fails to engage said hub portion to said escutcheon with said plug in either of said open or release positions.

* * * * *